US010731235B2

(12) United States Patent
Ota et al.

(10) Patent No.: US 10,731,235 B2
(45) Date of Patent: Aug. 4, 2020

(54) WIRE FOR REED SWITCH, REED PIECE FOR REED SWITCH, AND REED SWITCH

(71) Applicants: Sumitomo Electric Industries, Ltd., Osaka-shi, Osaka (JP); STANDEX ELECTRONICS JAPAN CORPORATION, Kofu-shi, Yamanashi (JP)

(72) Inventors: Hajime Ota, Osaka (JP); Tetsuya Kuwabara, Osaka (JP); Kazuo Yamazaki, Neyagawa (JP); Naoki Sugihara, Neyagawa (JP); Norimasa Kawano, Neyagawa (JP); Hiroyasu Torazawa, Kofu (JP)

(73) Assignee: Sumitomo Electric Industries, Ltd., Osaka-shi, Osaka (JP)

( * ) Notice: Subject to any disclaimer, the term of this patent is extended or adjusted under 35 U.S.C. 154(b) by 115 days.

(21) Appl. No.: 15/745,220

(22) PCT Filed: Jun. 24, 2016

(86) PCT No.: PCT/JP2016/068928
§ 371 (c)(1),
(2) Date: Jan. 16, 2018

(87) PCT Pub. No.: WO2017/014000
PCT Pub. Date: Jan. 26, 2017

(65) Prior Publication Data

US 2019/0017152 A1 Jan. 17, 2019

(30) Foreign Application Priority Data

Jul. 17, 2015 (JP) ..... 2015-143319

(51) Int. Cl.
*H01H 1/02* (2006.01)
*C22C 19/07* (2006.01)
(Continued)

(52) U.S. Cl.
CPC ..... *C22C 19/07* (2013.01); *C22F 1/10* (2013.01); *H01H 1/0201* (2013.01); *H01H 1/66* (2013.01);
(Continued)

(58) Field of Classification Search
CPC ..... H01H 1/0201; H01H 1/66; H01H 11/005; H01H 51/28–51/288
See application file for complete search history.

(56) References Cited

U.S. PATENT DOCUMENTS 3,989,557 A 11/1976 Henmi et al.
2015/0162142 A1 6/2015 Ota et al.

FOREIGN PATENT DOCUMENTS

JP S58-209103 A 12/1983
JP S58-224157 A 12/1983
(Continued)

*Primary Examiner* — Ramon M Barrera
(74) *Attorney, Agent, or Firm* — Faegre Drinker Biddle & Reath LLP

(57) ABSTRACT

There is provided a wire for a reed switch used for a material of a reed piece comprised by a reed switch, the wire being composed of an iron-group alloy containing Fe and 0 mass % or more and less than 10 mass % of Ni, with a total content of the Fe and the Ni satisfying 10 mass % or more and less than 20 mass %, with a balance of Co and an impurity, the iron-group alloy having a cubic crystal structure, the wire having a Curie temperature of 900° C. or higher and a specific resistance of 15 μΩ·cm or less at normal temperature, a ratio of a thermal expansion coefficient of a glass tube comprised by the reed switch to a thermal expansion coefficient of the wire for the reed switch being 90% or more, the wire having a diameter of 1 mm or less.

3 Claims, 1 Drawing Sheet

(51) Int. Cl.

| | |
|---|---|
| ***H01H 1/66*** | (2006.01) |
| ***H01H 51/28*** | (2006.01) |
| ***C22F 1/10*** | (2006.01) |
| *H01H 11/00* | (2006.01) |

(52) U.S. Cl.
CPC ..... *H01H 51/287* (2013.01); *H01H 11/005* (2013.01)

(56) References Cited

FOREIGN PATENT DOCUMENTS

| | | | |
|---|---|---|---|
| JP | S59-68117 | A | 4/1984 |
| JP | S60-70611 | A | 4/1985 |
| JP | S60-224730 | A | 11/1985 |
| JP | 2014-15669 | A | 1/2014 |

WIRE FOR REED SWITCH, REED PIECE FOR REED SWITCH, AND REED SWITCH

TECHNICAL FIELD

The present invention relates to a wire for a reed switch, a reed piece for a reed switch, and a reed switch.

The present application claims priority based on Japanese Patent Application No. 2015-143319 filed on Jul. 17, 2015, and incorporates herein all the contents described therein.

BACKGROUND ART

A reed switch as described in Patent Document 1 is used for switching parts such as relays and various sensor parts. A reed switch includes a plurality of reed pieces made of magnetic metal and a cylindrical glass tube filled with a sealed gas or the like, and the reed pieces are fixed to the glass tube such that the reed pieces have their respective one ends inserted into the glass tube in parallel and their respective other ends projecting out of the glass tube (see Patent document 1, the specification, paragraph [0002]). The reed pieces have their respective one ends in the glass tube serving as contact portions which are brought into and out of contact with each other by an electromagnet or the like disposed outside the glass tube (see Patent document 1, the specification, paragraph [0002]).

A representative material of the reed piece is a binary alloy of Fe and Ni referred to as 52 alloy or the like (see Patent document 1, the specification, paragraph [0003]). Patent Document 1 proposes a ternary alloy containing Co as a major component and containing Fe and Ni in a specific range.

PRIOR ART DOCUMENT

Patent Document

Patent document 1: Japanese Patent Laying-Open No. 2014-015669

SUMMARY OF INVENTION

A wire for a reed switch according to one aspect of the present disclosure is a wire for a reed switch used for a material of a reed piece comprised by a reed switch, the wire being composed of an iron-group alloy containing Fe and 0 mass % or more and less than 10 mass % of Ni, with a total content of the Fe and the Ni satisfying 10 mass % or more and less than 20 mass %, with a balance of Co and an impurity, the iron-group alloy having a cubic crystal structure, the wire having a Curie temperature of 900° C. or higher, the wire having a specific resistance of 15 μΩ·cm or less at normal temperature, a ratio of a thermal expansion coefficient of a glass tube comprised by the reed switch to a thermal expansion coefficient of the wire for the reed switch being 90% or more, the wire having a diameter of 1 mm or less.

DESCRIPTION OF EMBODIMENTS

Figure 1:
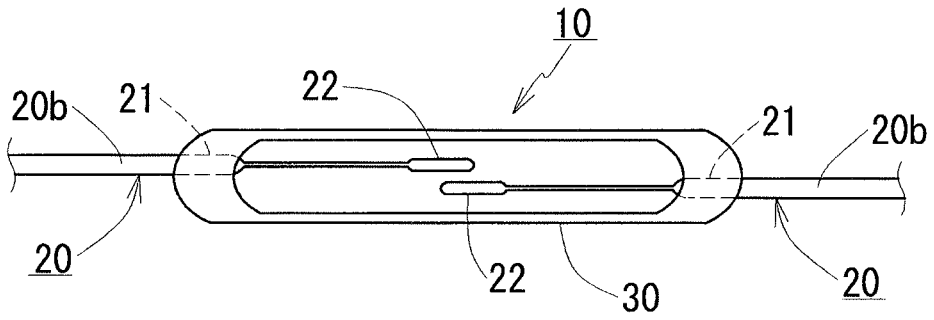
FIG. 1 schematically illustrates a reed switch according to an embodiment in an opened state.

Problem to be Addressed by the Present Disclosure

Patent Document 1 describes that a reed piece and a wire serving as a material of the reed piece which are composed of a ternary alloy having a specific composition have a high Curie temperature and a low resistance and are also excellent in workability, and are thus also suitable for reed switches used for large currents. However, in Patent Document 1, the reed piece's glass sealing property is not sufficiently studied, and there is room for improvement.

The glass sealing property is a property regarding a state of bonding of the reed piece to glass. When a reed piece having an excellent glass sealing property is used, there is no crack or the like at and around a portion of the glass tube that is bonded to the reed piece and the glass tube can be hermetically sealed satisfactorily. This can prevent the sealed gas from leaking externally from the interior of the glass tube and contaminants from externally entering the glass tube, and can hence prevent contact failure and the like attributed to oxidation and corrosion of the contact portions, adhesion of contaminants and the like.

While the reed piece composed of 52 alloy as set forth above has an excellent glass sealing property, it has a low Curie temperature and in addition has high resistance, and is thus unsuitable for a reed switch used for large currents.

Accordingly, an object is to provide a wire for a reed switch which has a high Curie temperature, a low resistance and excellent workability, and in addition also has an excellent glass sealing property.

Another object is to provide a reed piece for a reed switch which has a high Curie temperature and a low resistance and also has an excellent glass sealing property, and a reed switch comprising the reed piece.

Advantageous Effects of Present Disclosure

The wire for a reed switch disclosed herein has a high Curie temperature and a low resistance and also has excellent workability, and in addition also has an excellent glass sealing property.

Description of Embodiment of the Present Invention

Initially, embodiments of the present invention will be enumerated and specifically described.

(1) A wire for a reed switch according to one aspect of the present disclosure is a wire for a reed switch used for a material of a reed piece comprised by a reed switch, the wire being composed of an iron-group alloy containing Fe and 0 mass % or more and less than 10 mass % of Ni, with a total content of the Fe and the Ni satisfying 10 mass % or more and less than 20 mass %, with a balance of Co and an impurity, the iron-group alloy having a cubic crystal structure, the wire having a Curie temperature of 900° C. or higher, the wire having a specific resistance of 15 μΩ·cm or less at normal temperature, a ratio of a thermal expansion coefficient of a glass tube comprised by the reed switch to a thermal expansion coefficient of the wire for the reed switch (hereinafter also referred to as a matching ratio) being 90% or more, the wire having a diameter of 1 mm or less.

When the above wire for a reed switch is composed of a binary or ternary alloy of an iron-group element having a specific composition such that Co is a major component (exceeding 80 mass %), Fe is an essential component, the Fe content and the Ni content in total satisfy a specific range, and the Ni content is small, the wire achieves the following effects:

(a) A binary or ternary alloy of a specific composition essentially including Fe and excluding Ni or having a small Ni content can have a thermal expansion coefficient close to that of the glass tube and thus allows a high matching ratio and provides an excellent glass sealing property.

When the above wire for a reed switch is used as a reed piece of a reed switch the thermal expansion coefficient of the reed piece and the thermal expansion coefficient of the glass tube comprised by the reed switch have a small difference, which helps to reduce a difference between the amount in thermal expansion and contraction of the reed piece and that in thermal expansion and contraction of the glass. Accordingly, there is little stress that can be introduced due to the difference between the amounts in thermal expansion and contraction at and around a portion of the glass tube to which the reed piece is bonded, which can prevent the glass tube from cracking or the like due to the stress otherwise introduced. The reed switch including the reed piece can thus be hermetically sealed satisfactorily over a long period of time.

(b) Having Co as a major component allows a high Curie temperature and can prevent a magnetic characteristic from being decreased as temperature rises.

When the above wire for a reed switch is used as a reed piece of a reed switch used for large currents, and attains high temperature due to Joule heat, it does not easily reach Curie temperature and easily maintains a prescribed magnetic characteristic.

(c) While containing Co as a major component, also containing Fe allows a cubic crystal structure (y type structure) excellent in plastic workability, and hence excellent workability. Further containing Ni helps to provide a face-centered cubic crystal structure more excellent in plastic workability than a body-centered cubic crystal structure and thus allows more excellent workability.

Various plastic workings, such as wire drawing for forming a thin wire such as 1 mm or less, pressing for forming into a reed piece of a predetermined shape, and the like can be satisfactorily performed, and the above wire for a reed switch and a reed piece using this wire can be manufactured with high productivity.

(d) Although containing Co as a major component and Fe as an essential component, having a relatively small total of Fe and Ni contents allows a low specific resistance and hence a low resistance.

Using the above wire for a reed switch as a reed piece of a reed switch used for large currents can reduce an increase in temperature caused by Joule heat and prevents the reed piece from easily reaching high temperature. Thus, (d1) an increase of a thermal expansion coefficient due to an increase in temperature can be suppressed and a difference between amounts in thermal expansion/contraction as set forth above can be easily reduced, and (d2) Curie temperature is not easily reached and a prescribed magnetic characteristic is easily maintained.

In addition, the above wire for a reed switch has small wire diameter, which allows a reed piece to be formed for a small reed switch and can thus contribute to miniaturization of a reed switch.

(2) A reed piece for a reed switch according to one aspect of the present disclosure comprises:

a main body portion composed of the wire for a reed switch according to the above one aspect of the present disclosure; and a contact portion formed at one end side of the main body portion by plastic working.

The above reed piece for a reed switch substantially maintains the composition of the above wire for a reed switch, and has a high matching ratio and an excellent glass sealing property and in addition has a high Curie temperature and a low resistance. Furthermore, as the above reed piece for a reed switch is manufactured from the above wire for a reed switch excellent in plastic workability, it can be easily and precisely formed into a prescribed shape and is also excellent in manufacturability.

(3) A reed switch according to one aspect of the present disclosure is a reed switch comprising a cylindrical glass tube and a plurality of reed pieces each having one end side region with a contact portion and fixed to the glass tube with the one end side region inserted in the glass tube, the reed piece being the reed piece for a reed switch according to the above aspect of the present disclosure.

As the above reed switch comprises the above reed piece for a reed switch excellent in consistency with the thermal expansion coefficient of the glass tube, it has an excellent glass sealing property and can maintain satisfactory hermeticity over a long period of time. Furthermore, the above reed switch comprises the above reed piece for a reed switch having a high Curie temperature and a low resistance, and when a large current is passed therethrough, the reed switch does not easily attain high temperature, and can suppress deterioration of a characteristic caused by an increase in temperature, more specifically, reduction of a magnetic characteristic, an increase in specific resistance, an increase of a thermal expansion coefficient, and the like, and can be satisfactorily switched over a long period of time.

DETAILED DESCRIPTION OF EMBODIMENTS OF THE PRESENT INVENTION

The present invention will now be described in embodiments hereinafter in detail. When a composition is referred to, the content of any element thereof is represented in % by mass.

(Wire for Reed Switch)

In an embodiment, a wire for a reed switch is used as a material of a reed piece comprised by a reed switch, and is characterized in part by being composed of an iron-group alloy having a specific composition mainly composed of an iron-group metallic element.

For suitability not only to reed switches used for small currents but also to reed switches used for large currents, the inventors of the present invention have set an iron-group alloy that contains Co having a high Curie temperature and a low resistance as a major component, as a target composition for a reed piece and a wire serving as a material therefor, and have studied Fe and Ni contents for an improved glass sealing property. As a result, the present inventors have obtained findings that what allows cracking at and around a portion bonded to the glass provides a matching ratio of less than 90%, and what does not allow such cracking provides a matching ratio of 90% or more.

And in order to adjust a thermal expansion coefficient so as to obtain a matching ratio of 90% or more, the present inventors have obtained findings that it is preferable to essentially contain Fe and reduce the Ni content, and provide a total of the Fe content and the Ni content in a specific range. Based on the findings, the present inventors propose that a reed piece and a wire serving as a material therefor be composed of an iron-group alloy having a specific composition with Co as a major component and Fe as an essential component, with Fe and Ni contents in total and the Ni content falling within a specific range.

Composition

The iron-group alloy having a specific composition as described above is a binary alloy containing Co as a major component and Fe as an essential component, or a ternary alloy containing Co as a major component and Fe and Ni. A specific composition includes Fe and 0 mass % or more and less than 10 mass % of Ni, with a total of Fe and Ni contents in an amount of 10% or more and less than 20%, with a balance of Co and an impurity.

Fe

The Fe content is more than 0% and less than 20% as converted from the total amount of the Fe content and the Ni content. Larger Fe contents help to increase the matching ratio and in addition allow a cubic crystal structure to be easily obtained, and accordingly, the Fe content can be 5% or more. When further improvement of the matching ratio is considered, the Fe content can be 10% or more, furthermore, 11% or more, 12% or more, 12.5% or more. When Ni is contained, it is preferable that the Fe content be larger than the Ni content (i.e., exceeds the Ni content). A Fe content set to 19.5% or less, furthermore, 19% or less, 18.5% or less, helps to provide low resistance.

Fe+Ni

Setting the total of the Fe content and the Ni content in an amount of 10% or more and less than 20% and containing Fe as an essential component allow an iron-group alloy having a specific composition to have a thermal expansion coefficient close to that of the glass tube of the reed switch and a matching ratio of 90% or more to be satisfied. When the above total amount is larger, the Fe content can be included in a larger amount and accordingly, the matching ratio is easily increased, and in addition, as the Fe content and the Ni content increase, a cubic crystal structure is easily obtained and excellent workability is obtained. Accordingly, the above total amount can be 10.5% or more, furthermore, 11% or more, 11.5% or more. As the total amount is less than 20%, an increase in specific resistance is suppressed and low resistance is provided. The smaller the total amount is, the easier it is to lower resistance, and the above total amount can be 19.5% or less, furthermore, 19% or less, 18.5% or less.

Ni

The iron-group alloy having the specific composition as described above has a Ni content of less than 10%, and can thus suppress a decrease in the matching ratio and a decrease in Curie temperature due to an increase of the Ni content, and can thus have a high matching ratio and a high Curie temperature. A smaller Ni content allows a decrease of the matching ratio and a decrease of the Curie temperature to be suppressed, and the Ni content can be 9.5% or less, furthermore, 9% or less, 8.5% or less, and excluding Ni, i.e., 0% of Ni, is permitted. In contrast, containing Ni in addition to Fe helps the alloy to have a face-centered cubic crystal structure, which is more excellent in workability among cubic crystal structures, and can thus enhance workability, and accordingly, the Ni content can be 1% or more, furthermore, 2% or more, 2.5% or more.

Co

The iron-group alloy having the specific composition as described above contains Co, which has a high Curie temperature and a low specific resistance, in an amount exceeding 80%, and thus has a high Curie temperature and a small specific resistance. Although it contains a large amount of Co, it contains at least Fe, as described above, and accordingly, it is excellent in workability, and when it contains Ni, it is more excellent in workability.

Impurity

The iron-group alloy having the specific composition as described above permits containing an impurity. The impurity is composed of an element/elements contained in an amount preferably of 1% or less in total. The impurity's element/elements can be reduced, for example, by refining when fusing.

An example of the impurity is an inevitable impurity which is unintentionally introduced during the manufacturing process, e.g., an element such as C (carbon). Larger C contents can invite reduction in workability and accordingly, a C content of 0.01% or less is preferable.

Other examples of the impurity include elements, such as Cr, Mn, Si, Al, and Ti, which are intentionally added for the purpose of deoxidation or the like. While the listed elements function as a deoxidizing agent, they invite an increased specific resistance, a decreased magnetic characteristic and the like when they are contained in large amounts. Accordingly, the total content of Cr, Mn, Si, Al and Ti is preferably 0.9% or less.

Structure

In an embodiment, a wire for a reed switch is characterized in part in that the iron-group alloy having the specific composition as described above has a cubic crystal structure. The wire having a cubic crystal structure is excellent in workability and is satisfactorily subjected to various plastic workings such as wire drawing for forming a thin wire of such as 1 mm or less, press working for forming a predetermined shape, and the like. In particular, having a face-centered cubic crystal structure rather than a body-centered cubic crystal structure allows more excellent workability and is thus preferable. The iron-group alloy has a crystal structure mainly depending on the composition, and it is advisable to adjust the Fe content and the Ni content within the above specific content range to allow the alloy to be cubic crystal. Containing Ni helps to obtain a face centered cubic crystal structure.

Thermal Characteristic

In an embodiment, a wire for a reed switch is characterized in part in that a ratio of the thermal expansion coefficient of the above wire to the thermal expansion coefficient of the glass tube comprised by the reed switch, that is, a matching ratio, is high, and it is 90% or more. When the matching ratio is higher, and this wire is used as a reed piece of a reed switch, cracking or the like can be prevented from occurring at and around a portion of the glass tube that is bonded to the reed piece and an excellent glass sealing property can be achieved. Accordingly, the matching ratio can be 91% or more, furthermore, 91.5% or more, 92% or more, and there is no upper limit set therefor, in particular. The matching ratio mainly depends on the composition, and when the Fe content is large in the above specific range, the matching ratio tends to increase.

Magnetic Characteristic

In an embodiment, a wire for a reed switch is characterized in part by having a high Curie temperature of 900° C. or higher. With higher Curie temperatures, degradation of a magnetic characteristic accompanying an increase in temperature does not easily occur, and there is no upper limit set for Curie temperature, in particular. The Curie temperature mainly depends on the composition, and it tends to be higher as the Co content increases, and it can be 950° C. or higher, furthermore, 970° C. or higher, 1000° C. or higher.

Electrical Characteristic

In an embodiment, a wire for a reed switch is characterized in part by having a small specific resistance, and having a specific resistance of 15 μΩ·cm or less at normal temperature. When the specific resistance is lower, an increase in temperature due to Joule heat can be suppressed even when a large current is passed, and there is no lower limit set for the specific resistance in particular. The specific resistance depends mainly on the composition and easily becomes lower for smaller Fe and Ni contents and larger Co contents, and it can be 14 μΩ·cm or less, furthermore, lower than 12 μΩ·cm, and lower than 10 μΩ·cm.

Shape

In an embodiment, a wire for a reed switch is representatively a round wire having a circular lateral cross section. Other examples thereof include an angled polygonal wire having a lateral cross section including a rectangular shape, a deformed wire having a lateral cross section of a deformed shape such as an ellipse.

Size

In an embodiment, a wire for a reed switch is characterized in part by having a wire diameter of 1 mm or less. The wire diameter is a diameter in the case of a round wire, and a diameter of an enveloping circle in the case of an angled wire or a deformed wire or the like. The wire diameter can be appropriately selected in accordance with the reed piece's design value, and is, for example, about 0.2 mm or more and 0.8 mm or less. It is advisable to select a wire drawing degree to obtain a desired wire diameter. A wire for a reed switch having a wire diameter of 1 mm or less has a small diameter, and a small reed piece and hence a small reed switch can be manufactured.

In an embodiment, a wire for a reed switch is not particularly limited in length. A long wire is typically wound in the form of a coil. The wire may be cut to have a prescribed length (e.g., the reed piece's designed length) to be a short material.

Method for Manufacturing a Wire for a Reed Switch

In an embodiment, a wire for a reed switch can be manufactured through the steps of melting→casting→hot working (forging, rolling, etc.)→cold wire drawing and heat treatment.

In particular, it is preferable to prepare in a vacuum an alloy melt with adjusted components and refine the melt to remove/reduce impurities and inclusions, adjust temperature, and/or the like as doing so can reduce impurities and inclusions. Subjecting such an alloy melt to casting such as vacuum casting to produce an ingot, which is in turn subjected to hot working to obtain a worked material, which is in turn subjected to cold wire drawing and a heat treatment repeatedly can provide a wire of a small diameter. Subjecting a wire of a final wire diameter to a softening treatment allows the wire to be excellent in toughness such as elongation, in other words, excellent in workability.

(Reed Piece for Reed Switch)

In an embodiment, a reed piece for a reed switch is a linear body and has at least one end side provided with a contact portion formed by plastic working. Specifically, as shown in FIG. 1, a reed piece 20 for a reed switch includes a main body portion 20*b* composed of a wire for a reed switch according to the embodiment and a contact portion 22 formed at one end side of main body portion 20*b* by plastic working. Although contact portion 22 is not particularly limited in shape, an example thereof is a shape having a planar region, as shown in FIG. 1, to have a sufficient contact area. Reed piece 20 has the other end side, which is not subjected to plastic working for forming contact portion 22 of a predetermined shape and substantially maintains a specification (e.g., composition, structure, shape, size and the like) of the wire for the reed switch in the above embodiment used for a material. The composition, structure and properties of the iron-group alloy constituting a region subjected to plastic working as described above substantially maintain the composition, structure and properties of the wire for the reed switch according to the embodiment used for the material.

In an embodiment, reed piece 20 for a reed switch can be manufactured as follows: a wire for a reed switch according to the embodiment is cut to have a prescribed (or designed) length and then has one end side pressed or subjected to similar, plastic working to form contact portion 22 having a desired shape such as in the form of a plate.

(Reed Switch)

Figure 2:
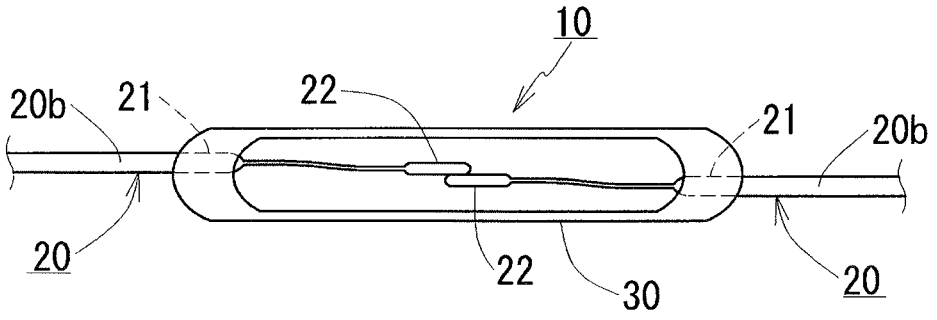
FIG. 2 schematically illustrates the reed switch according to the embodiment in a closed state.

With reference to FIG. 1 and FIG. 2, a reed switch 10 of an embodiment will be described. Reed switch 10 has a basic configuration similar to that of a conventional reed switch, and it includes a cylindrical glass tube 30 and a plurality of reed pieces 20 each having one end side region with contact portion 22 and fixed to glass tube 30 with the one end side region inserted in glass tube 30. Reed piece 20 is a reed piece for a reed switch of the embodiment obtained by subjecting the wire for a reed switch of the above embodiment to plastic working.

Each reed piece 20 has the one end side region having contact portion 22 inserted into glass tube 30, an intermediate region fixed to glass tube 30 and thus serving as a fixed portion 21, and the other end side region exposed from glass tube 30. Reed pieces 20 have their respective contact portions 22 overlapping one another in the longitudinal direction of glass tube 30 and spaced in the radial direction of glass tube 30 (i.e., in an opened state), as show in FIG. 1. A magnet (not shown) is disposed outside glass tube 30, and when a magnetic attractive force is exerted by the magnet, contact portions 22 are brought into contact with each other (i.e., a closed state) as shown in FIG. 2. When the magnetic attractive force is removed, reed piece 20 exhibits resilience and contact portions 22 return to a contactless state, as shown in FIG. 1. Reed switch 10 thus utilizes a magnet to perform an opening/closing operation (i.e., switching).

As shown in FIG. 1, reed switch 10 representatively comprises a pair of reed pieces 20 having their respective one ends fixed to end potions, respectively, of cylindrical glass tube 30 in parallel, as shown in FIG. 1.

Alternatively, it includes a form which includes three reed pieces 20, of which two reed pieces 20 are mutually spaced and fixed to one end of cylindrical glass tube 30 in parallel and one reed piece 20 is fixed to the other end thereof, and one reed piece 20 has one end side region inserted and thus disposed between those of two reed pieces 20.

For example, glass tube 30 includes what is made of glass having a thermal expansion coefficient of about $120\times10^{-7}$/° C. to $130\times10^{-7}$/° C. (12 ppm/K to 13 ppm/K). Reed switch 10 satisfies as reed piece 20 a matching ratio of 90% or more relative to the thermal expansion coefficient of glass tube 30.

In glass tube 30, gaseous nitrogen or a similar inert gas, a low-oxygen gas containing a small amount of oxygen such as a vacuum, or a non-oxygen gas containing no substantial oxygen is sealed to prevent oxidation, corrosion and the like of contact portion 22. Reed switch 10 comprises reed piece 20 having a matching ratio of 90% or more in particular, and it can thus be hermetically sealed satisfactorily and sufficiently effectively prevent oxidation, corrosion and the like of contact portion 22. Note that contact portion 22 is also mechanically protected by glass tube 30.

Basically, reed switch 10 can be manufactured by a conventional manufacturing method or a known manufacturing method. Representatively, reed piece 20 is inserted through and thus disposed at one end of a glass tube having opposite ends open. Subsequently, in this condition, the one end is heated to fix reed piece 20 to the glass tube. Thereafter, another reed piece 20 is inserted through and thus disposed at the other end of the glass tube with a desired atmosphere set, and in that condition the other end is heated to fix the other reed piece 20 to the glass tube and also seal glass tube 30. Reed switch 10 is thus obtained. When reed piece 20 having an oxide film previously formed at a portion thereof brought into contact with the glass is used, excellent bondability is provided between reed piece 20 and glass tube 30.

Providing a platinum-group layer such as rhodium (Rh) or ruthenium (Ru) on a surface of contact portion 22 can reduce contact resistance. The platinum-group layer can be formed by plating, welding or the like.

(Application)

In an embodiment, a wire for a reed switch can be used as a material of a reed piece comprised by a reed switch. In an embodiment, a reed piece for a reed switch can be used as a component of the reed switch. In an embodiment, a reed switch can be applied in combination with a magnet such as a permanent magnet and an electromagnet to switching parts and sensing parts in various types of electric and electronic devices. Specific examples of switching parts and sensing parts include: reed relays, speed sensors and shock sensors for in-vehicle components; reed relays, security sensors, gas flow rate sensors for parts of household electric appliances; and proximity sensors of mobile phones for parts of portable electrical equipment. In an embodiment, a reed switch can also be suitably used not only for small currents such as an electrical current having a value of 1 A or less when energized as a matter of course but also for large currents such as an electrical current having a value of 3 A or more, furthermore, 5 A or more when energized.

Test Example 1

Wires of iron-group alloys having various compositions with Co as a major component were produced and their structures, magnetic characteristics, electrical characteristics, thermal characteristics, and glass sealing properties were examined.

The iron-group alloy wires are produced through a process of melting→casting→surface cutting→hot forging→hot rolling→cold wire drawing and heat treatment. Specifically the process proceeds as follows:

An ordinary vacuum melting furnace is used to prepare an alloy melt such that Co, Fe, and Ni contents are as indicated in table 1 at a column "components" (represented in mass %). The melt is refined to reduce/remove impurity and the like.

The prepared melt is adjusted in temperature as appropriate and undergoes vacuum casting to produce an ingot.

The obtained ingot has a surface cut to remove an oxide layer and the like, and is subsequently subjected to hot forging and hot rolling sequentially to provide a rolled wire having a wire diameter of 5.5 mmφ.

The obtained rolled wire is subjected to a combination of cold wire drawing and heat treatment to obtain a wire having a wire diameter (a diameter) of 0.6 mmφ.

Each such obtained wire's composition was analyzed with an ICP emission spectroscopic analyzer, and found to be substantially similar to the Co, Fe and Ni contents used for a source material. The wire composition analysis can also be done using atomic absorption photometry or the like.

For each obtained sample's wire, a measurement result is indicated in Table 1, as follows:

(1) Structure: A crystal structure analysis through X-ray diffraction is employed to examine a crystal structure.

(2) Magnetic characteristic: A commercially available differential scanning calorimeter (DSC) is used to measure Curie temperature (° C.).

(3) Electrical Characteristic: A commercially available electrical resistance measuring instrument is used to examine a specific resistance (in μΩ·cm) at normal temperature (herein, about 20° C.) by a direct-current four-terminal method.

(4) Thermal Characteristic: A commercially available measuring instrument is used to examine the wire's thermal expansion coefficient (in ppm/K) in a temperature range of 30° C. to 400° C. to obtain a matching ratio (in %) relative to the glass's thermal expansion coefficient.

The matching ratio is represented by ((glass's thermal expansion coefficient)/(wire's thermal expansion coefficient))×100. Herein, the glass's thermal expansion coefficient is assumed to be 12 ppm/K.

(5) Glass Sealing Property: A glass tube having a thermal expansion coefficient of 12 ppm/K is prepared and the wire is sealed in and thus attached to the glass tube, and thereafter a visual observation is conducted to confirm whether there is cracking at and around a portion of the glass tube at which the wire is bonded. A case without cracking is assessed as G and a case with cracking is assessed as B.

TABLE 1

| sample | components (mass %) | | | | crystal | Curie temperature | specific resistance | thermal expansion coefficient | matching ratio of thermal expansion coefficient relative to | glass sealing |
|---|---|---|---|---|---|---|---|---|---|---|
| nos. | Co | Ni | Fe | Fe + Ni | structure | (° C.) | (μΩ · cm) | (ppm/K) | glass (%) | property |
| 1-1 | Bal | 0 | 13.2 | 13.2 | cubic | 1010 | 8.1 | 13 | 92 | G |
| 1-2 | Bal | 4.1 | 7.1 | 11.2 | cubic | 1050 | 7.6 | 13.2 | 91 | G |
| 1-3 | Bal | 4.1 | 13.2 | 17.3 | cubic | 1000 | 9 | 13 | 92 | G |
| 1-101 | 100 | 0 | 0 | 0 | hexagonal | 1115 | 6.2 | 9 | 75 | B |

TABLE 1-continued

| sample nos. | components (mass %) Co | Ni | Fe | Fe + Ni | crystal structure | Curie temperature (° C.) | specific resistance (μΩ · cm) | thermal expansion coefficient (ppm/K) | matching ratio of thermal expansion coefficient relative to glass (%) | glass sealing property |
|---|---|---|---|---|---|---|---|---|---|---|
| 1-102 | Bal | 25 | 8 | 33 | cubic | 980 | 12 | 16 | 75 | B |
| 1-103 | Bal | 10 | 10 | 20 | cubic | 1000 | 10 | 13.5 | 89 | B |

As shown in Table 1, Sample Nos. 1-1 to 1-3 composed of an iron-group alloy having a specific composition with Co as a major component provide wires having a cubic crystal, a high Curie temperature, and a low resistance, and in addition, having a matching ratio of 90% or more, and it can be seen that they have an excellent glass sealing property. The wires of Sample Nos. 1-1 to 1-3 specifically have the following characteristics:

Curie temperature: 900° C. or higher, furthermore, 1000° C. or higher;

Specific resistance: 15μΩ·cm or less, furthermore, less than 10 μΩ·cm, furthermore, 9 μΩ or less; and Matching ratio: 90% or more, furthermore, 91% or more.

In contrast, Sample Nos. 1-101 composed of Co provides a wire having a high Curie temperature and a low resistance, although having a low matching ratio of less than 80%. Furthermore, this wire has a hexagonal crystal structure. Hexagonal crystal is a crystal structure which is generally considered to be difficult to deform and easily crack, and it is believed that it is difficult to use the wire of Sample No. 1-101 to form parts accompanied by large deformation, e.g., a reed piece for a reed switch.

Sample No. 1-102 composed of a ternary alloy containing a large amount of Ni and having a total of 20 mass % or more of Fe and Ni contents provides a wire having a Curie temperature of 900° C. or higher and a specific resistance of 15μΩ·cm or less, although having a low matching ratio of less than 80%.

Sample No. 1-103 composed of a ternary alloy having a total of Fe and Ni contents smaller than that of Sample No. 1-102, i.e., 20 mass %, and having Fe and Ni contents equally, can provide a wire having a somewhat increased Curie temperature, a somewhat reduced specific resistance, and a thermal expansion coefficient approaching that of the glass, although having a matching ratio of less than 90%. When the matching ratio is less than 90%, cracking occurs similarly as observed in Sample No. 1-102.

When the wires of Sample Nos. 1-1 to 1-3 essentially containing Fe, reducing Ni and having a total of Fe and Ni contents in an amount of 10 mass % or more and less than 20 mass % are compared with the wire of Sample No. 1-103, the former have a thermal expansion coefficient closer to that of the glass than the latter, and thus have a matching ratio of 90% or more and do not cause cracking. From this test result, whether the matching ratio satisfies 90% would be used as an indicator in determining whether a wire has a good glass sealing property (or whether there is cracking). Furthermore, an iron-group alloy having a specific composition satisfying a matching ratio of 90% or more, and also containing Co as a major component, Fe, and little Ni can be said to have an excellent glass sealing property.

When wires of Sample Nos. 1-1 to 1-3 as above are used for a reed piece of a reed switch, they can reduce a difference from the glass tube in amount of thermal expansion and contraction and thus less easily cause cracking or the like at and around a portion of the glass tube that is bonded to the reed piece and are expected to maintain hermetic sealing over a long period of time. In addition, this reed piece has a high Curie temperature and a low resistance and accordingly, when a large current is passed therethrough the reed piece less easily invites a reduced magnetic characteristic, an increased specific resistance and an increased thermal expansion coefficient and is thus expected to maintain a prescribed characteristic satisfactorily. Thus it is expected that these wires can be suitably used not only for small currents but also as a material for reed pieces of reed switches for large currents.

Furthermore, the wires of Sample Nos. 1-1 to 1-3 having a cubic crystal structure while containing Co as a major component can be satisfactorily drawn to be a thin wire such as of 1 mm or less and are thus also excellent in workability. The wires of Sample Nos. 1-1 to 1-3 were cut to have a prescribed length and, simulating a contact portion of a reed piece for a reed switch, the wires each had one end formed into a flat plate with a thickness of about 0.1 mm, and they had a peripheral edge without cracking or the like visually observed and were thus satisfactorily formed. From this fact, it can be seen that the wires of Sample Nos. 1-1 to 1-3 are excellent in workability.

Furthermore, from this test, it can be said as follows:

When a Fe content is noted in a range of 10 mass % or more and less than 20 mass % of Fe and Ni contents in total, with the Ni content being less than 10 mass %, as can be seen from Sample Nos. 1-1 and 1-3, a Fe content of more than 12 mass %, furthermore, 12.5 mass % or more, 13 mass % or more can further increase the matching ratio and in addition can further increase Curie temperature although somewhat increasing the specific resistance.

In contrast, when Fe and Ni are both contained, as seen from Sample No. 1-2, a Fe content of less than 8 mass %, furthermore, 7.5 mass % or less allows the matching ratio to be maintained at 90% or more, the specific resistance to be lower (herein, 8 μΩ·cm or less) and Curie temperature to be higher (herein, higher than 1010° C., furthermore, 1030° C. or higher), which is expected to be more suitably applied for large currents.

The present invention is defined by the terms of the claims, rather than the examples described above, and is intended to include any modifications within the meaning and scope equivalent to the terms of the claims. For example, the composition, wire diameter and the like of the iron-group alloy of Test Example 1 can be changed.

REFERENCE SIGNS LIST

10: reed switch

20: reed piece, 20*b*: main body portion, 21: fixed portion, 22: contact portion

30: glass tube

The invention claimed is:

1. A wire for a reed switch used for a material of a reed piece comprised by a reed switch, the wire being composed of an iron-group alloy containing more than 12 mass % of Fe and more than 0 mass % and less than 10 mass % of Ni, with a total content of the Fe and the Ni satisfying more than 12 mass % and less than 20 mass %, with a balance of Co and an impurity, the iron-group alloy having a cubic crystal structure, the wire having a Curie temperature of 900° C. or higher, the wire having a specific resistance of 15μΩ•cm or less at normal temperature, a ratio of a thermal expansion coefficient of a glass tube comprised by the reed switch to a thermal expansion coefficient of the wire for the reed switch being 90% or more, the wire having a diameter of 1 mm or less.

2. A reed piece for a reed switch comprising: a main body portion composed of the wire for a reed switch according to claim 1; and a contact portion formed at one end side of the main body portion by plastic working.

3. A reed switch comprising a cylindrical glass tube and a plurality of reed pieces each having one end side region with a contact portion and fixed to the glass tube with the one end side region inserted in the glass tube, the reed piece being the reed piece for a reed switch according to claim 2.

* * * * *